US006563433B2

(12) United States Patent
Fujiwara

(10) Patent No.: US 6,563,433 B2
(45) Date of Patent: May 13, 2003

(54) LIQUEFIED RAW GARBAGE COLLECTION METHOD AND SYSTEM

(75) Inventor: Shintaro Fujiwara, Ichikawa (JP)

(73) Assignee: Exy Concept Co., Ltd., Kashiwa (JP)

( * ) Notice: Subject to any disclaimer, the term of this patent is extended or adjusted under 35 U.S.C. 154(b) by 0 days.

(21) Appl. No.: 09/874,962

(22) Filed: Jun. 7, 2001

(65) Prior Publication Data

US 2001/0051083 A1 Dec. 13, 2001

(30) Foreign Application Priority Data

Jun. 8, 2000 (JP) ..... 2000-172070

(51) Int. Cl.[7] ..... G08G 1/123
(52) U.S. Cl. ..... 340/988; 340/933; 702/43
(58) Field of Search ..... 340/901, 903, 340/933, 934, 988, 995; 53/436, 471; 4/225.1, 286, DIG. 4; 100/229 A, 252; 702/43

(56) References Cited

U.S. PATENT DOCUMENTS 3,788,027 A * 1/1974 Figari ..... 53/436
4,767,065 A 8/1988 Wray
5,014,206 A * 5/1991 Scribner et al. ..... 340/825.49
5,214,594 A * 5/1993 Tyler et al. ..... 100/229 A
5,489,898 A * 2/1996 Shigekusa et al. ..... 340/988

FOREIGN PATENT DOCUMENTS

| | | | |
|---|---|---|---|
| DE | 4336334 | | 11/1994 |
| DE | 4321754 | | 2/1995 |
| DE | 29821866 | | 3/1999 |
| JP | 0099893 | * | 4/2000 |
| JP | 2000-107622 | | 9/2000 |

* cited by examiner

*Primary Examiner*—Van Trieu
(74) *Attorney, Agent, or Firm*—Varndell & Varndell, PLLC

(57) ABSTRACT

Information is exchanged between raw garbage liquefying devices and a central station so that the central station manages the liquefied raw garbage accumulated amounts in the respective raw garbage liquefying devices, selects raw garbage liquefying devices to be visited, and issues instructions for collection to a touring collection vehicle.

15 Claims, 7 Drawing Sheets

LIQUEFIED RAW GARBAGE COLLECTION METHOD AND SYSTEM

BACKGROUND OF THE INVENTION

1. Field of the Invention

The present invention relates to a liquefied raw garbage collection method and system, and more particularly, to a liquefied raw garbage collection method and system whereby collection of liquefied raw garbage can be performed efficiently by touring collection vehicles.

2. Description of the Related Art

Generally, collection of raw garbage is performed by a method wherein the date or day of the week on which a raw garbage collection vehicle tours around garbage collection points, is determined, and each household is requested to place their raw garbage at a predetermined collection point, early on the day on which the raw garbage collection vehicle passes by, for example. There is also another method wherein raw garbage is collected by previously arranged by telephone or the like so that the collection vehicle is requested to pass by a prescribed point at a prescribed date and time.

However, in methods where raw garbage is placed directly at garbage collection points, problems arise in that the garbage may be attacked by cats, crows, or the like, or it may produce unpleasant odours, before the collection vehicle arrives at the garbage collection point.

Therefore, in order to prevent the raw garbage from being attacked by cats, crows, etc., it is necessary to take measures such as providing a raw garbage collection container at the garbage collection point, placing a net over the garbage bags or the like.

However, in conventional methods using containers, nets and the like, such situations may sometimes occur that the quantity of raw garbage exceeds the storage capacity of the containers, or the generation of unpleasant odours cannot sufficiently suppressed. Hence, it causes problems to determine where garbage collection points are located because hygiene-related problems may occur in the neighborhood of the collection points.

Furthermore, if a large amount of raw garbage happens to be produced by household, then it must either request a another visit of the raw garbage collection vehicle, or the garbage must be stored in the household until the collection vehicle visits next time.

Since raw garbage will decompose with the passage of time, if the raw garbage is stored inside the household, problems arise with regard to hygiene, for instance, unpleasant odours are produced.

To solve the problems, a raw garbage collection system has been proposed, wherein raw garbage liquefying apparatuses are provided in distributed locations adjacent to respective households or the like, and the raw garbage liquefied by the raw garbage liquefying apparatus is collected and stored in highly sealed liquefied raw garbage storage tanks. Then, the liquefied raw garbage deposited in the liquefied raw garbage storage tanks is recovered periodically by touring collection vehicles, whereby raw garbage can be collected without dispersing unpleasant smells into the surrounding area.

By means of this raw garbage collection system, it is possible to place raw garbage into a raw garbage liquefying apparatus at any time, and hence generation of unpleasant odours due to decomposition of the raw garbage can be prevented, thereby providing a significant merits in terms of hygiene.

However, in the aforementioned raw garbage collection system, collection must be performed without fail before the amount of liquefied raw garbage accumulated inside the liquefied raw garbage storage tank of the raw garbage liquefying device exceeds the permitted amount.

If, as illustrated in FIG. 6, the touring collection vehicle 6 visits every raw garbage liquefying devices 8 which need liquefied raw garbage to be collected therefrom and every raw garbage liquefying device 9 which do not need liquefied raw garbage to be collected therefrom, then it will make unnecessary collections, which is inefficient.

Moreover, since the touring collection vehicle 6 passes along the touring route a large number of times, the distance travelled by the collection vehicle is long, and the fuel consumed by the touring vehicles increases, thereby not only causing costs to increase, but also raising the amount of exhaust gas generated, which has a detrimental effect on the environment in addition to the economic aspects.

SUMMARY OF THE INVENTION

Therefore, it is an object of the present invention to provide a liquefied raw garbage collection method and system whereby touring collection vehicles can collect liquefied raw garbage from the liquefied raw garbage accumulation tanks of raw garbage liquefying devices situated in a plurality of dispersed locations in an efficient manner.

The liquefied raw garbage collection method according to the present invention is a liquefied raw garbage collection method wherein the liquefied raw garbage accumulated respectively in a plurality of raw garbage liquefying devices situated in a plurality of distributed locations is collected by means of a plurality of touring collection vehicles; the accumulation state of the liquefied raw garbage in each of the plurality of raw garbage liquefying devices being monitored by a central station by exchanging information between the plurality of raw garbage liquefying devices and the central station; and the central station issuing collection instructions for the liquefied raw garbage from the plurality of raw garbage liquefying devices, to the plurality of touring collection vehicles, on the basis of the results of the monitoring.

With this configuration, it is possible to dispatch touring collection vehicles only to those raw garbage liquefying devices which require collection of liquefied raw garbage, and hence highly efficient raw garbage collection can be achieved.

Here, it is possible to adopt a configuration wherein the central station confirms the respective current positions of the plurality of touring collection vehicles by exchanging information through radio communications with the plurality of touring collection vehicle; and issues collection instructions for the liquefied raw garbage from the plurality of raw garbage liquefying devices to the plurality of touring collection vehicles, on the basis of the respective current positions of the plurality of touring collection vehicles thus confirmed.

With this configuration, it is possible to issue a collection instruction to a touring collection vehicle that is near a raw garbage liquefying device from which liquefied raw garbage is to be collected, and hence fuel consumption and the time required for touring collection can be reduced.

Furthermore, it is also possible for the central station to confirm the respective current liquefied raw garbage collected amounts of the plurality of touring collection vehicles by exchanging information through radio communications with the plurality of touring collection vehicle; and to issue collection instructions for the liquefied raw garbage from the plurality of raw garbage liquefying devices to the plurality of touring collection vehicles, on the basis of the respective current liquefied raw garbage collected amounts of the plurality of touring collection vehicles thus confirmed.

With this configuration, it is possible to issue a collection instruction to a touring collection vehicle which is situated near to a raw garbage liquefying device requiring collection and which is capable of collecting the whole amount of liquefied raw garbage accumulated therein.

Moreover, it is also possible to collect the whole amount of liquefied raw garbage by issuing collection instructions to a plurality of touring collection vehicles located near to the raw garbage liquefying device requiring collection.

Furthermore, it is also possible to adopt a configuration wherein the raw garbage liquefying devices comprise liquefied raw garbage accumulated amount detecting means for detecting the current accumulated amount of liquefied raw garbage in the raw garbage liquefying device, the liquefied raw garbage accumulated amount detected by the liquefied raw garbage accumulated amount detecting means being notified to the central station at prescribed intervals.

With this configuration, the central station is able to manage, with good accuracy, the amount of liquefied raw garbage accumulated in each of the raw garbage liquefying devices.

Moreover, since the liquefied raw garbage accumulated amounts are updated at regular intervals, omissions in the accumulated amounts can be prevented.

It is also possible to adopt a configuration wherein the raw garbage liquefying devices comprise liquefied raw garbage accumulated amount detecting means for detecting the current accumulated amount of liquefied raw garbage in the raw garbage liquefying device, the liquefied raw garbage accumulated amount detected by the liquefied raw garbage accumulated amount detecting means being notified to the central station on the basis of requests from the central station.

With this configuration, the central station is able to ascertain the liquefied raw garbage amounts currently accumulated in the raw garbage liquefying devices, accurately and in real time.

Furthermore, it is also possible to adopt a configuration wherein the touring collection vehicles comprise position detecting means for detecting the current position of the touring collection vehicle, and liquefied raw garbage collection amount detecting means for detecting the current collected amount of liquefied raw garbage therein, the current position of the touring collection vehicle as detected by the position detecting means and the current liquefied raw garbage collected amount as detected by the liquefied raw garbage collected amount detecting means being notified to the central station at prescribed intervals.

With this configuration, the central station is able to manage the positions and liquefied raw garbage collected amounts of the touring collection vehicles.

Furthermore, collection instructions can be issued to touring collection vehicles situated near the raw garbage liquefying devices to be collected from, and capable of collecting the full amount of accumulated liquefied raw garbage therein.

It is also possible to adopt a configuration wherein the touring collection vehicles comprise position detecting means for detecting the current position of the touring collection vehicle, and liquefied raw garbage collection amount detecting means for detecting the current collected amount of liquefied raw garbage therein, the current position of the touring collection vehicle as detected by the position detecting means and the current liquefied raw garbage collected amount as detected by the liquefied raw garbage collected amount detecting means being notified to the central station on the basis of requests from the central station.

With this configuration, the central station is able to ascertain accurately the current position and liquefied raw garbage collected amount of the touring collection vehicles.

It is also possible to adopt a configuration wherein the central station: gathers the respective liquefied raw garbage accumulated amounts of the raw garbage liquefying devices by exchanging information through radio communications with the plurality of raw garbage liquefying devices, establishes a visit plan for the plurality of touring collection vehicles on the basis of the gathered results, and issues collection instructions for the liquefied raw garbage from the raw garbage liquefying devices, to the touring collection vehicles, on the basis of the visit plan.

With this configuration, since the central station establishes a visit plan and issues instructions to the touring collection vehicles, it is possible to cause only raw garbage liquefying devices which require collection of liquefied raw garbage to be visited, by means of the shortest possible distance.

Moreover, in a case where the tank of a touring collection vehicle is virtually full of liquefied raw garbage, the raw garbage liquefying devices may be indicated to the vehicle in such a manner that it ends its touring collection, thereby achieving further increases in efficiency.

Furthermore, it is also possible to adopt a configuration wherein the central station: gathers operational status data for the raw garbage liquefying devices by exchanging information through radio communications with the plurality of raw garbage liquefying devices, and loads the operational status data to a homepage; identifies a user having accessed the home page via the Internet, by means of an ID and password; and supplies the operational status data for the raw garbage liquefying devices to a user for whom the ID and password are correct.

With this configuration, a user can ascertain the operational states of the raw garbage liquefying devices from a remote location, by means of an Internet connection, and hence extremely flexible and highly efficient gathering of raw garbage can be achieved.

With this configuration, the liquefied raw garbage collection system according to the present invention is a liquefied raw garbage collection system wherein the liquefied raw garbage accumulated respectively in a plurality of raw garbage liquefying devices situated in a plurality of distributed locations is collected by means of a plurality of touring collection vehicles; comprising a central station for exchanging information through radio communications with the plurality of raw garbage liquefying devices; the central station being provided with: liquefied raw garbage accumulation state monitoring means for monitoring the accumulation state of the liquefied raw garbage in each of the plurality of raw garbage liquefying devices, on the basis of exchanging information with the plurality of raw garbage liquefying devices; and collection instruction issuing means for issuing collection instructions for the liquefied raw garbage from the plurality of raw garbage liquefying devices, through radio communications, to the plurality of touring collection vehicles, on the basis of the results of the monitoring performed by the liquefied raw garbage accumulation state monitoring means.

Therefore, the amount of liquefied raw garbage in the plurality of raw garbage liquefying devices can be managed and only raw garbage liquefying devices requiring collection of liquefied raw garbage are selected and indicated to the touring collection vehicles for collection, thereby making it possible to reduce the amount of fuel consumed by the touring collection vehicles and the time required for the touring collection.

Here, it is possible to adopt a configuration wherein the exchanging of information between the plurality of raw garbage liquefying devices and the central station is carried out by packet transmission on the basis of instructions from the raw garbage liquefying devices or from the central station, and by so doing, it is possible to make very efficient use of a communications network for exchanging information.

Furthermore, a configuration may also be adopted wherein the raw garbage liquefying devices comprise: liquefied raw garbage accumulated amount detecting means for detecting the current liquefied raw garbage accumulated amount thereof; and notifying means for notifying the liquefied raw garbage accumulation data thus detected by the liquefied raw garbage accumulated amount detecting means, to the central station, at prescribed intervals or upon the request of the central station.

This configuration enables the central station to manage the amounts of liquefied raw garbage accumulated in the raw garbage liquefying devices, in an accurate manner.

It is also possible to adopt a configuration wherein the touring collection vehicles comprise: position detecting means for detecting the current position of the touring collection vehicle; liquefied raw garbage collected amount detecting means for detecting the current liquefied raw garbage collected amount of the touring collection vehicle; and notifying means for notifying the current position of the touring collection vehicle as detected by the position detecting means and the current liquefied raw garbage collected amount as detected by the liquefied raw garbage collected amount detecting means, to the central station, at prescribed intervals or upon requests from the central station.

With this configuration, the central station is able to manage the position and liquefied raw garbage collected amount of the touring collection vehicles, in an accurate manner, and can also ascertain, in an accurate manner, the amount of liquefied raw garbage that can be collected by each touring collection vehicle.

A configuration may also be adopted wherein the notifying means notifies the current position of the touring collection vehicle as detected by the position detecting means and the current liquefied raw garbage collected amount as detected by the liquefied raw garbage collected amount detecting means, by packet transmission on the basis of instructions from the touring collection vehicle or the central station, and by so doing, it is possible to make very efficient use of a communications network for exchanging information.

Moreover, it is also possible to adopt a configuration wherein the central station comprises: liquefied raw garbage accumulated amount gathering means for gathering the liquefied raw garbage accumulated amount of each of the raw garbage liquefying devices, by exchanging information through radio communications with the plurality of raw garbage liquefying devices; touring collection vehicle information gathering means for gathering the respective position and liquefied raw garbage collected amount of the touring collection vehicles, by exchanging information through radio communications with the plurality of touring collection vehicles; and visit plan creating means for creating a visit plan for the plurality of touring collection vehicles on the basis of the results gathered by the liquefied raw garbage accumulated amount gathering means and the touring collection vehicle information gathering means; the collection instruction issuing means issuing collection instructions for the liquefied raw garbage from the raw garbage liquefying devices to the touring collection vehicles, on the basis of a visit plan created by the visit plan creating means.

In this case, the central station is able to issue a collection instruction to a touring collection vehicle which is situated near a raw garbage liquefying device requiring collection and which is capable of collecting the full amount of accumulated liquefied raw garbage therein.

Moreover, the full amount of accumulated liquefied raw garbage can be collected by issuing collection instructions to a plurality of touring collection vehicles situated near a raw garbage liquefying device requiring collection.

Furthermore, by issuing a collection instruction for a raw garbage liquefying device having an accumulated amount of raw garbage which will practically fill the tank of a touring collection vehicle, the tank of the touring collection vehicle is caused to assume a practically full state, and hence the touring collection thereof can be ended.

According to the present invention, by exchanging information between respective raw garbage liquefying devices and a central station, by means of radio communications devices, it is possible to ascertain, accurately, at the central station, the amount of liquefied raw garbage accumulated in each of the respective raw garbage liquefying devices, and hence the number of visits made by touring collection vehicles can be minimised.

Furthermore, it is also possible to ascertain, accurately, at the central station, the position of each touring collection vehicle and the amount of liquefied raw garbage that can be loaded into same, thereby permitting efficient dispatching of vehicles.

Moreover, since the central station can be accessed from a source external to the central station, it is possible to ascertain the liquefied raw garbage accumulated amounts and operational statuses of the raw garbage liquefying devices in real time, from a remote location, by means of the central station.

Yet further, according to the present invention, since information is exchanged between the raw garbage liquefying devices and the central station by means of radio communications, then management can be performed readily, even in the case of raw garbage liquefying devices situated in locations where telephone lines, or the like, are difficult to provide.

DESCRIPTION OF THE PREFERRED EMBODIMENTS

A method and system for collecting liquefied raw garbage accumulated in raw garbage liquefying devices according to the present invention is described below by means of an embodiment with reference to the accompanying drawings.

The liquefied raw garbage collection method and system for same according to the present invention comprises a central station which exchanges information through radio communications with a plurality of raw garbage liquefying devices, the raw garbage accumulation state of each raw garbage liquefying device being monitored by the central station, which issues liquefied raw garbage collection instructions to touring collection vehicles on the basis of the monitoring results.

Figure 1:
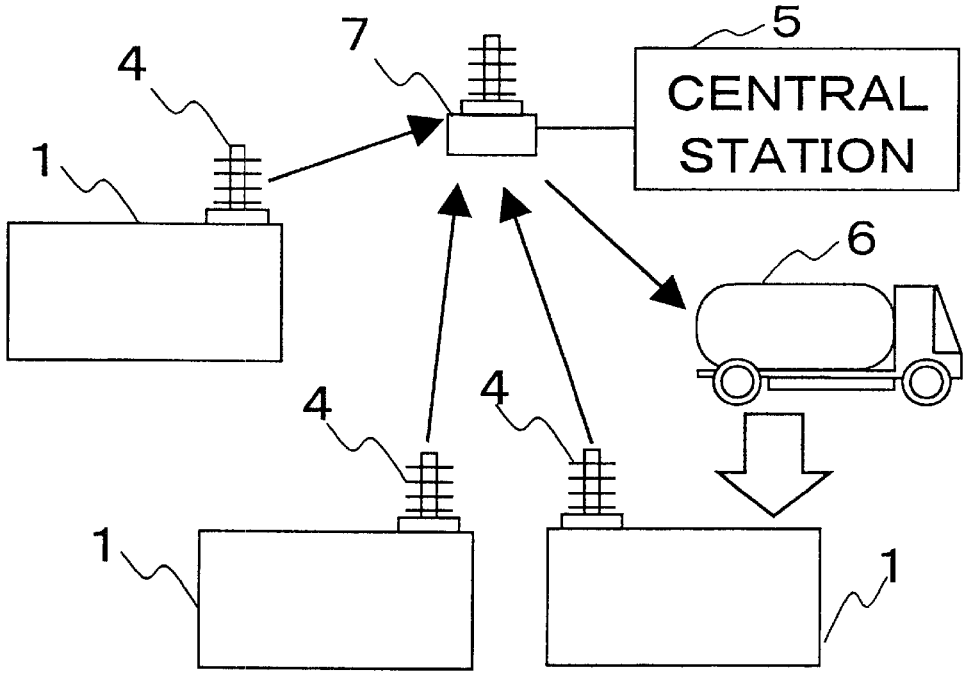
FIG. 1 is a schematic diagram of a liquefied raw garbage collection system according to the present invention.

FIG. 1 is a schematic diagram of a liquefied raw garbage collection system according to the present invention, wherein the central station 5 exchanges information with raw garbage liquefying devices 1 and a touring collection vehicle 6, by means of a radio communications circuit.

Figure 9:
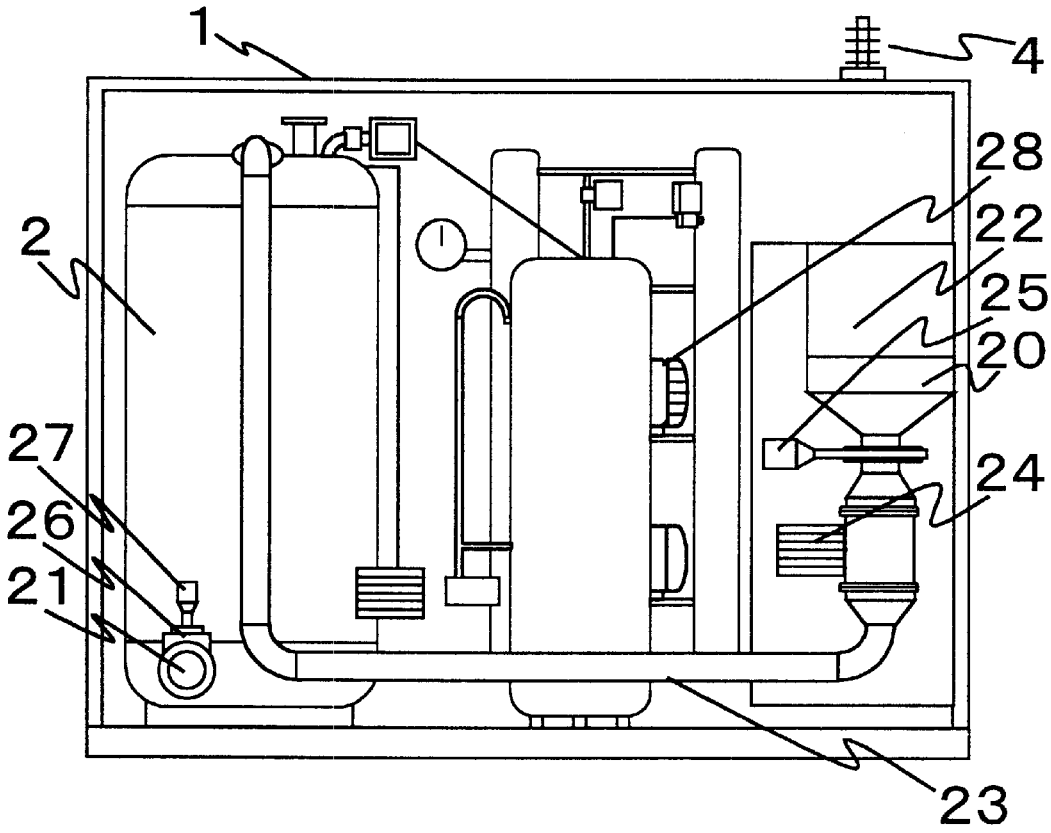
FIG. 9 is a schematic diagram of a raw garbage liquefying device.

As illustrated in FIG. 9, the raw garbage liquefying device comprises an input opening 20 for introducing raw garbage, a storage tank 2 for accumulating liquefied raw garbage and a discharge opening 21 for discharging liquefied raw garbage.

An input opening door 22 is provided in the input opening 20 and a chopping cutter 24 and input opening shut-off valve 25 are provided in the input section 23, while a discharge section shut-off valve 27 is provided in the discharge section 26.

Furthermore, a gas exhaust device 28 is provided inside the storage tank 2 for discharging gas from the input section 23 and the interior of the storage tank 2.

After closing the input opening shut-off valve 25 and the discharge opening shut-off valve 27 and removing the gas from the input section 20 and the interior of the storage tank 2 by the use of the gas exhaust device 28, raw garbage is introduced into the input section 20.

When the input opening door 22 is closed, the input opening shut-off valve 25 opens and the input raw garbage is conveyed into the storage tank 2 by means of pressure difference between the input opening 20 and the storage tank 2. During this, the raw garbage is broken up and liquefied by the chopping cutter 24.

Moreover, an accumulation sensor 3 detecting the amount of liquefied raw garbage accumulated in the storage tank 2 and a radio communications device 4 for exchanging information with the central station 5 are provided in the raw garbage liquefying device 1.

Operation sensors (not illustrated) for detecting operational status are provided at least at the input opening 20, discharge opening 21 and storage tank 2 of the raw garbage liquefying device 1.

The touring collection vehicles 6 is provided with a position locating device 30 using a GPS, PHS, or the like, in order to identify the current position thereof, and a radio communication device 31 for exchanging information with the central station 5.

The central station 5 exchanges information with a plurality of touring collection vehicles 6, ascertains an accurate location for each touring collection vehicle 6, and manages the respective touring collection vehicles 6.

Moreover, a load sensor for detecting the amount of liquefied raw garbage accumulated in the tank of the touring collection vehicle 6 is provided in each touring collection vehicle 6, and by notifying the liquefied raw garbage load data to the central station by means of the radio communications device, the central station is able to manage the liquefied raw garbage load in each touring collection vehicle 6.

The central station 5 comprises a radio device 7 for exchanging information with a plurality of raw garbage liquefying devices 1 and touring collection vehicles 6, and exchanges information with the plurality of raw garbage liquefying devices 1 by means of the radio communications devices 4 and 7, manages the accumulated amount of liquefied raw garbage in each raw garbage liquefying device 1 by means of the accumulation data detected by the respective accumulation sensors 3, and also manages the operational status of each raw garbage liquefying device by means of the operational data detected by the respective operation sensors.

Furthermore, the central station 5 selects a raw garbage liquefying device 1 from which liquefied raw garbage is to be collected by means of the accumulation data, and selects a touring collection vehicle 6 presently located nearest to the raw garbage liquefying device 1, and then issues a collection instruction to the selected touring collection vehicle 6 by means of the radio communications device 7.

Rather than selecting a touring collection vehicle 6 from the distance between the touring collection vehicle 6 and the raw garbage liquefying device 1, a touring collection vehicle 6 may be selected from a predicted arrival time at the raw garbage liquefying device as predicted from the road conditions such as traffic congestion and traffic restrictions. By doing so, it may achieve more efficient management of touring collection time.

It is also possible to select a touring collection vehicle 6 that is capable of loading the full amount of liquefied raw garbage accumulated in the raw garbage liquefying device, from the current liquefied raw garbage load of each touring collection vehicle.

Figure 2:
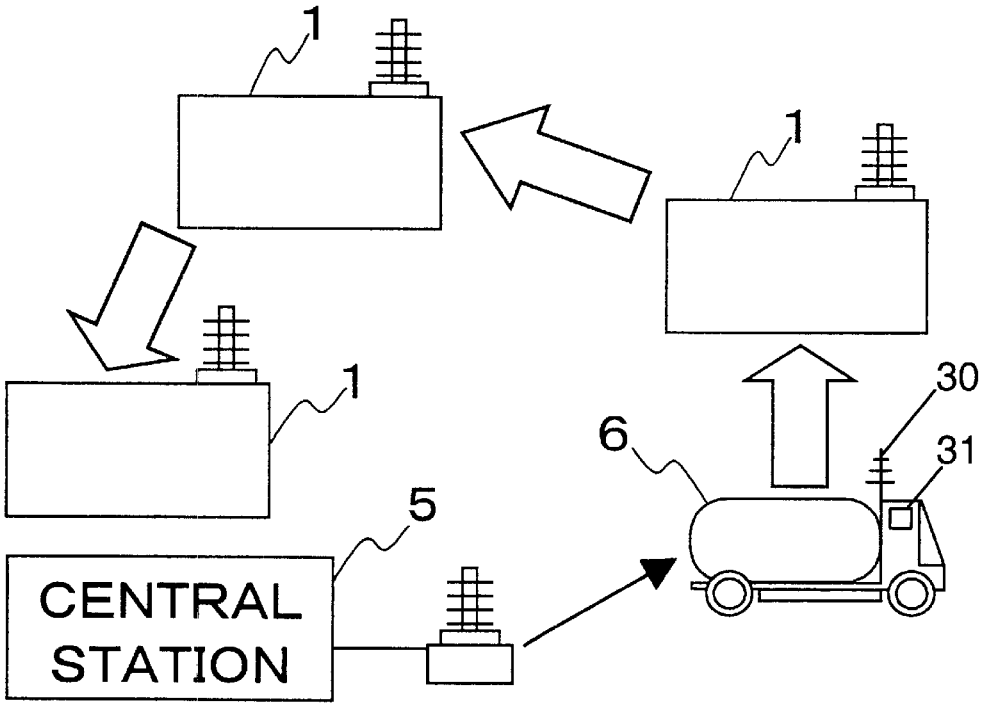
FIG. 2 is a schematic diagram of a liquefied raw garbage collection system according to an embodiment.
Figure 3:
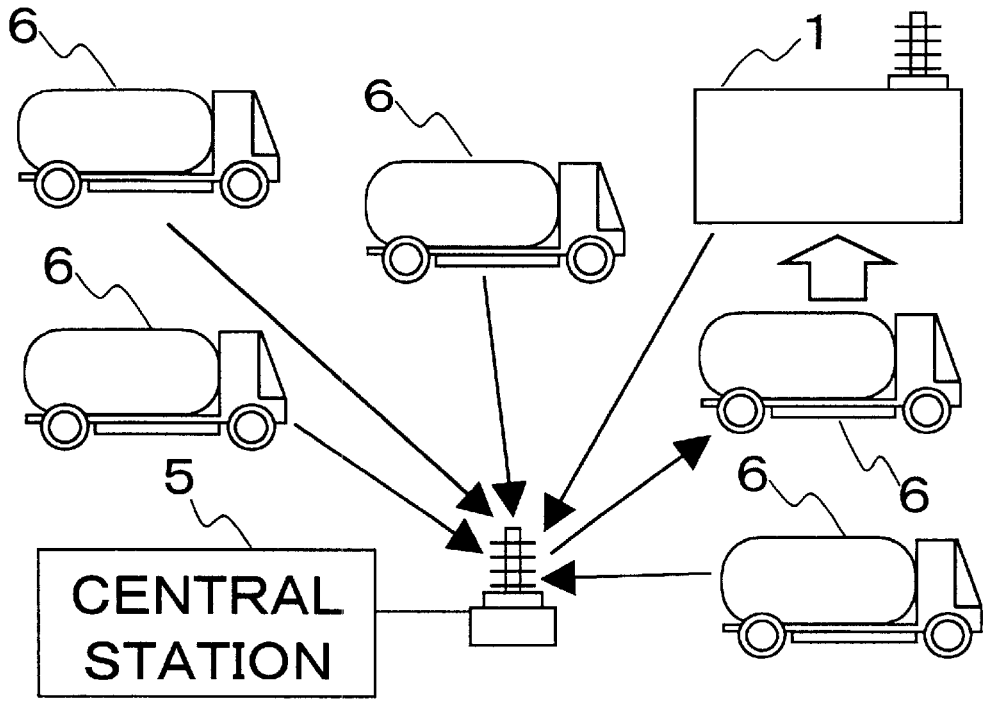
FIG. 3 is a schematic diagram of a liquefied raw garbage collection system according to an embodiment.

A liquefied raw garbage collection instruction made from the central station 5 to the touring collection vehicle 6 may indicate a collection route and collection order, as illustrated in FIG. 2, rather than simply indicating the name or location of the respective raw garbage liquefying devices that are to be collected from.

Upon arriving at a raw garbage liquefying device 1 for which the collection instruction has been received, the touring collection vehicle 6 connects a hose linked to the tank of the touring collection vehicle 6 to the discharge opening of the raw garbage liquefying device 1, and by applying suction from the touring collection vehicle 6, or by applying pressure to the liquefied raw garbage from the storage tank 2, the liquefied raw garbage is conveyed to the tank of the touring collection vehicle 6.

In this way, according to the present invention, raw garbage liquefying devices from which collection is to be made are selected by using accumulation data for the liquefied raw garbage accumulated inside the raw garbage liquefying devices, and this liquefied raw garbage is collected by making a touring collection vehicle visit the selected raw garbage liquefying devices.

Figure 6:
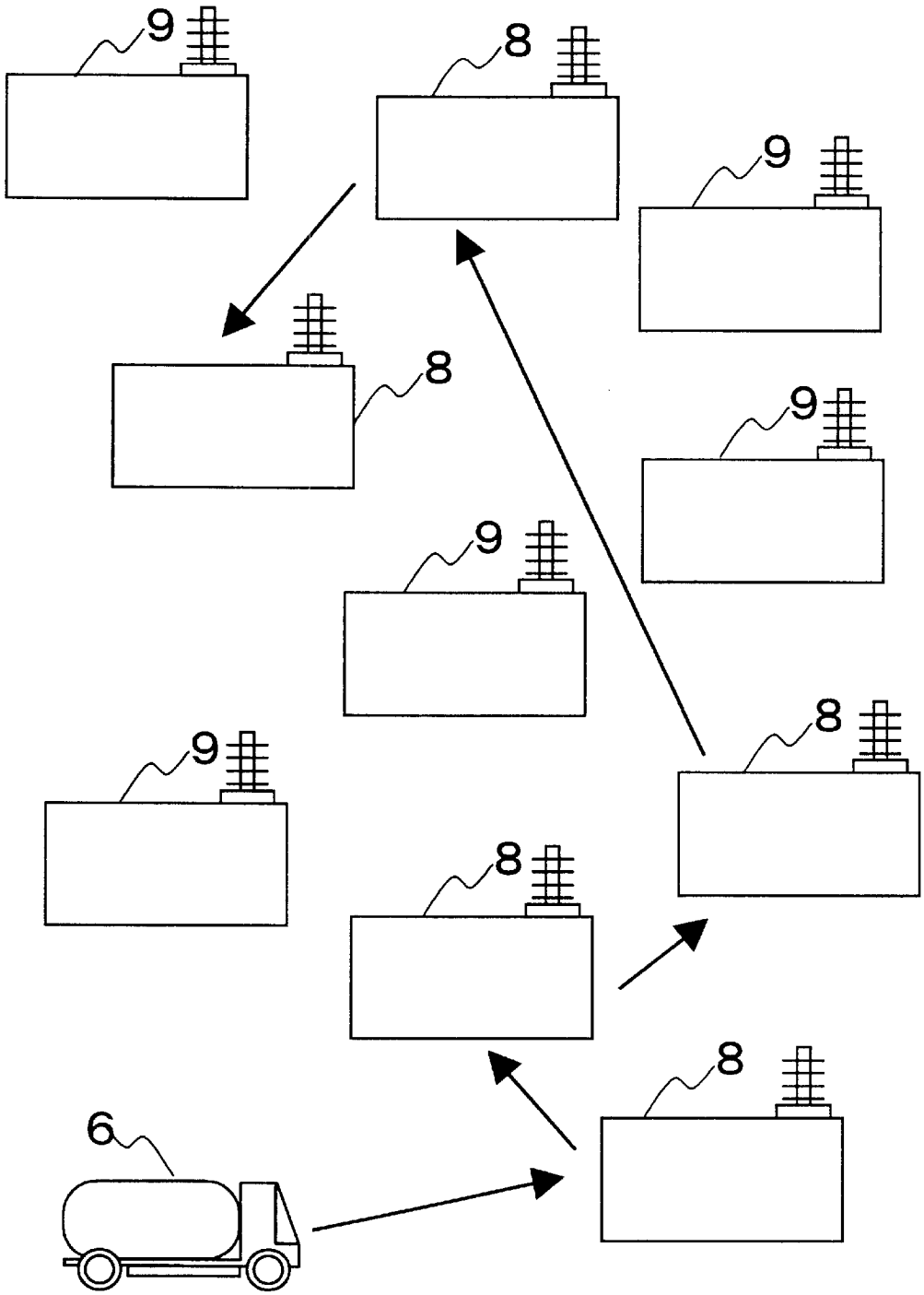
FIG. 6 is a schematic diagram illustrating touring collection of liquefied raw garbage as performed by a touring collection vehicle according to the present invention.
Figure 7:
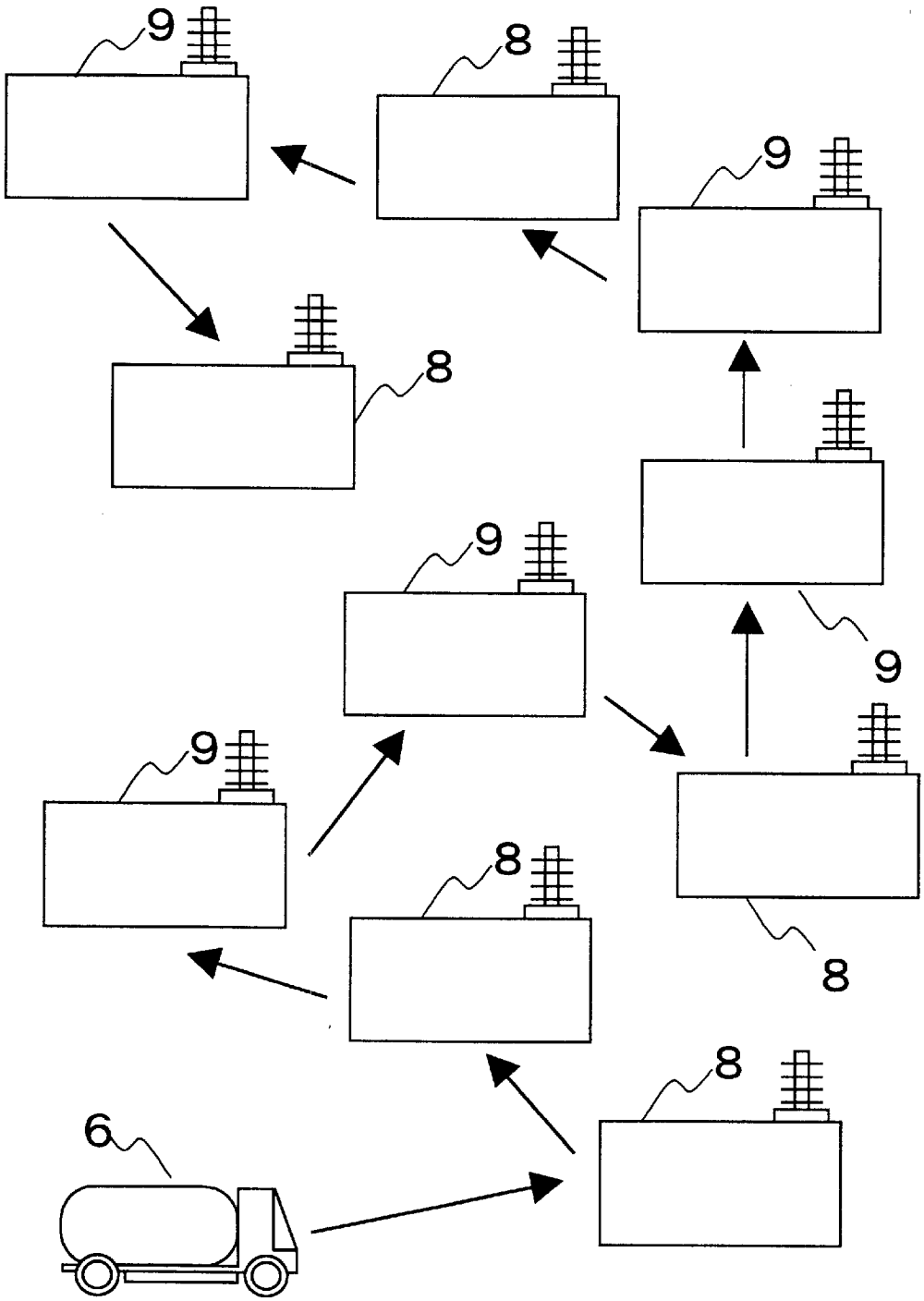
PRIOR ART Fig. 7
FIG. 7 is a schematic diagram illustrating touring collection of liquefied raw garbage as performed by a touring collection vehicle conventionally.

FIG. 6 is a schematic diagram showing touring collection of raw garbage liquefying devices as performed by a touring collection vehicle according to the present invention, and FIG. 7 is a schematic diagram showing touring collection of raw garbage liquefying devices as performed by a touring collection vehicle conventionally. In these drawings, numeral 8 denotes raw garbage liquefying devices which require the liquefied raw garbage to be collected therefrom and numeral 9 denotes raw garbage liquefying devices which do not require the liquefied raw garbage to be collected therefrom.

In touring collection of raw garbage liquefying devices by a touring collection vehicle 6 as performed conventionally, the touring collection vehicle 6 visits and collects from all of the raw garbage liquefying devices 8 which require collection of liquefied raw garbage and all of the raw garbage liquefying devices 9 which do not require collection of liquefied raw garbage, as illustrated in FIG. 7.

As a result, the distance that the touring collection vehicle has to travel in one tour is long, and the time required for the tour is long. Therefore, the costs in terms of fuel expenses and labour are high. Furthermore, there is a significant detrimental effect on the environment due to exhaust gas and the like.

On the other hand, according to the present invention, the central station manages each raw garbage liquefying device and issues collection instructions to the touring collection vehicle so that, as illustrated in FIG. 7, the touring collection vehicle 6 is able to visit only the raw garbage liquefying devices 8 requiring collection of liquefied raw garbage therefrom.

In this way, since the touring collection vehicle 6 is able to tour in an efficient manner, the distance that the touring collection vehicle 6 has to travel in one tour can be reduced to a minimum, and consequently, the time required for the tour can be shortened. As a result, costs associated with fuel, labour, etc. are reduced, and also the discharge of exhaust gases is reduced, hence providing a beneficial effect to the environment.

Figure 4:
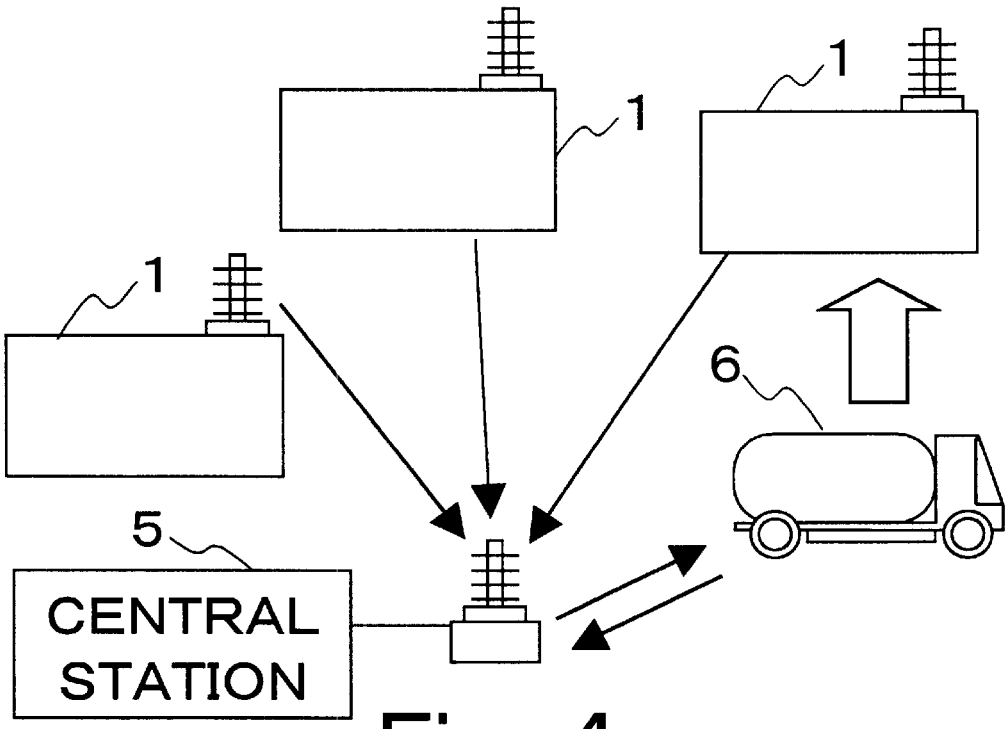
FIG. 4 is a schematic diagram of a liquefied raw garbage collection system according to an embodiment.
Figure 5:
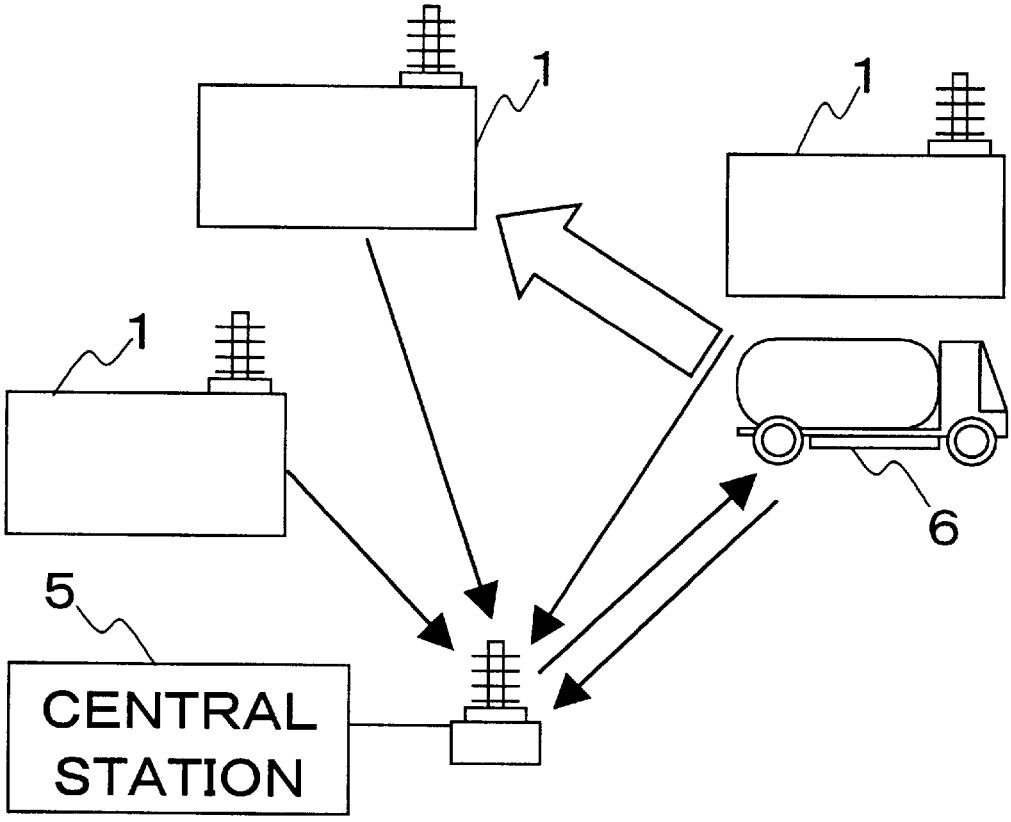
FIG. 5 is a schematic diagram of a liquefied raw garbage collection system according to an embodiment.

Moreover, according to the present invention, the central station 5 can ascertain accurately the accumulated amounts of liquefied raw garbage and the positions of the touring collection vehicles, and manage the amount of liquefied raw garbage that can be loaded into a touring collection vehicle. Therefore, it is possible to collect liquefied raw garbage in such a manner that the central station 5 selects a raw garbage liquefying device 1 to be collected according to the touring collection vehicle 6 and the liquefied raw garbage accumulated amounts, and indicates the touring collection vehicle 6 to collect garbage from the raw garbage liquefying devices 1 as illustrated in FIG. 4, and once collection of liquefied raw garbage from the indicated raw garbage liquefying device 1 has been completed, the central station 5 selects the next raw garbage liquefying device 1 to be collected from and issues a corresponding instruction to the touring collection vehicle 6 as illustrated in FIG. 5.

Moreover, since the liquefied raw garbage accumulation data for each raw garbage liquefying device 6 can be obtained at the time of the selection of the raw garbage liquefying device to be collected, then it is possible to respond appropriately to the circumstances as they arise, even when the liquefied raw garbage accumulated amount in the raw garbage liquefying devices is changed unpredictably, or suddenly increased greatly in a short period of time.

When an operation sensor detects an abnormality in the operational status, then the raw garbage liquefying device 1 immediately issues an abnormality signal to the central station 5. The central station 5 having received this abnormality signal selects a touring collection vehicle 6 to be dispatched rapidly to the raw garbage liquefying device 1 issuing the abnormality signal, considering the positions of the touring collection vehicles 6, etc., and issues a rapid dispatch instruction to the selected touring collection vehicle 6 by means of the radio communications device 7, Furthermore, it is also possible to adopt a system whereby, upon receiving an abnormality signal from a raw garbage liquefying device 1, the central station 5 transmits the information from the raw garbage liquefying device 1 to a certain mobile telephone, or the like.

Moreover, the liquefied raw garbage accumulated amounts and the operational statuses of the raw garbage liquefying devices can be placed on a home page of a server connected to the central station so that the state of any raw garbage liquefying device can be ascertained in real time from a remote location.

Figure 8:
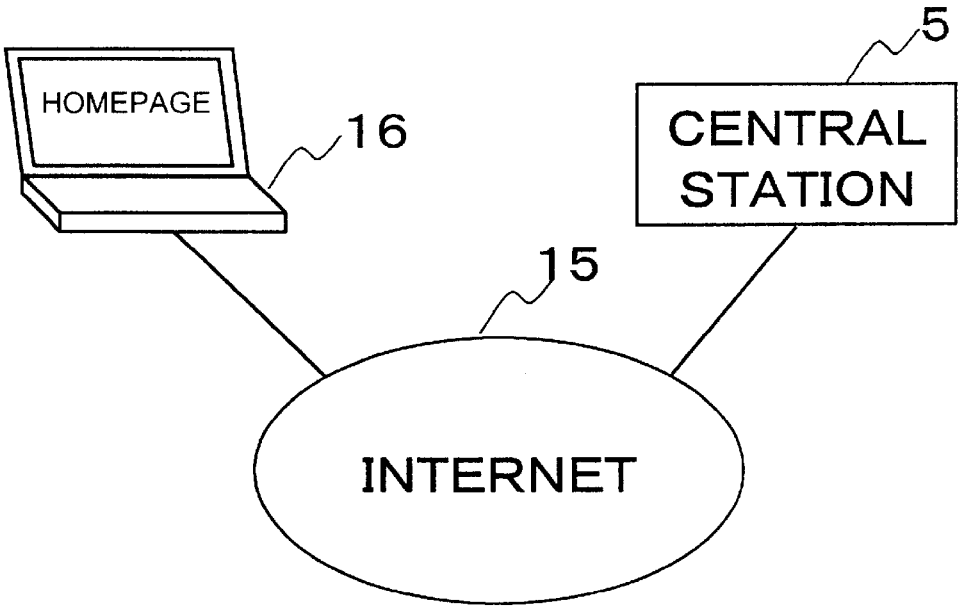
FIGS. 8(*a*) and 8(*b*) are schematic diagrams of access performed between a user and a central station according to an embodiment.
Figure 8:
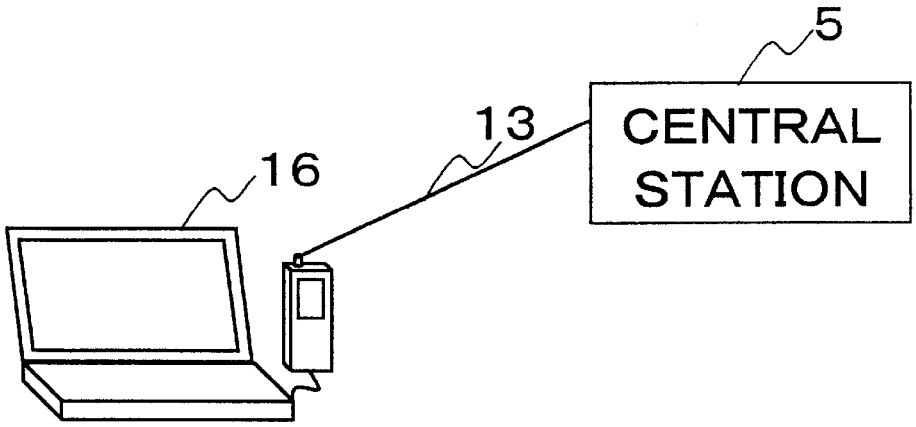

As illustrated in FIG. 8(*a*), when a user accesses the home page via the Internet 15, the user is identified by means of an ID and password, and if the combination of ID and password is judged to be correct, then the liquefied raw garbage accumulated amount data and operational status data from the raw garbage liquefying devices previously set as being monitorable, is supplied to the user.

Furthermore, if the user accesses the home page by means of a dedicated circuit 13 rather than the Internet, as shown in FIG. 8(*b*), then the telephone number of a mobile phone can be used as an ID or as an ID and password.

Although, in the present embodiment, the accumulated amount data and operational data were supplied via a home page, the information supplied is not limited to this information, and any information can be supplied provided that the information can be obtained through communications between the raw garbage liquefying devices and the central station.

What is claimed is:

1. A method of collecting liquefied raw garbage accumulated in a plurality of raw garbage liquefying devices situated in a plurality of locations by means of a plurality of touring collection vehicles, which comprises:

accumulating liquefied raw garbage in the plurality of raw garbage liquefying devices, and a central station monitoring an accumulation state of the liquefied raw garbage in each of the plurality of raw garbage liquefying devices through exchanging information between the plurality of raw garbage liquefying devices and the central station, and electronically issuing collection instructions for collecting the liquefied raw garbage from the plurality of raw garbage liquefying devices to the plurality of touring collection vehicles, based on results of the monitoring.

2. The method of collecting liquefied raw garbage according to claim 1, wherein the central station confirms respective current positions of the plurality of touring collection vehicles by exchanging information through radio communications with the plurality of touring collection vehicle, and issues collection instructions for collecting the liquefied raw garbage from the plurality of raw garbage liquefying devices to the plurality of touring collection vehicles, based on the respective current positions of the plurality of touring collection vehicles thus confirmed.

3. The method of collecting liquefied raw garbage according to claim 1, wherein the central station confirms respective current liquefied raw garbage collected amounts of the plurality of touring collection vehicles by exchanging information through radio communications with the plurality of touring collection vehicle, and issues collection instructions for collecting the liquefied raw garbage from the plurality of raw garbage liquefying devices to the plurality of touring collection vehicles, based on the respective current liquefied raw garbage collected amounts of the plurality of touring collection vehicles thus confirmed.

4. The method of collecting liquefied raw garbage according to claim 1, wherein the raw garbage liquefying devices comprise liquefied raw garbage accumulated amount detecting means for detecting current accumulated amount of liquefied raw garbage in the raw garbage liquefying device, and the liquefied raw garbage accumulated amount detected by the liquefied raw garbage accumulated amount detecting means is notified to the central station at prescribed intervals.

5. The method of collecting liquefied raw garbage according to claim 1, wherein the raw garbage liquefying devices comprise liquefied raw garbage accumulated amount detecting means for detecting current accumulated amount of liquefied raw garbage in the raw garbage liquefying device, and the liquefied raw garbage accumulated amount detected by the liquefied raw garbage accumulated amount detecting means is notified to the central station upon a request from the central station.

6. The method of collecting liquefied raw garbage according to claim 1, wherein the touring collection vehicles comprise position detecting means for detecting current position of the touring collection vehicle, and liquefied raw garbage collection amount detecting means for detecting current collected amount of liquefied raw garbage therein, and current position of the touring collection vehicle as detected by the position detecting means and the current liquefied raw garbage collected amount as detected by the liquefied raw garbage collected amount detecting means are notified to the central station at prescribed intervals.

7. The method of collecting liquefied raw garbage according to claim 1, wherein the touring collection vehicles comprise position detecting means for detecting current position of the touring collection vehicle, and liquefied raw garbage collection amount detecting means for detecting current collected amount of liquefied raw garbage therein, and the current position of the touring collection vehicle as detected by the position detecting means and the current liquefied raw garbage collected amount as detected by the liquefied raw garbage collected amount detecting means are notified to the central station upon a request from the central station.

8. The method of collecting liquefied raw garbage according to claim 1, wherein the central station gathers respective liquefied raw garbage accumulated amounts of the plurality of raw garbage liquefying devices by exchanging information through radio communications with the raw garbage liquefying devices, gathers the respective current positions and respective current liquefied raw garbage collected amounts of the plurality of touring collection vehicles by exchanging information through radio communications with the touring collection vehicles, establishes a visit plan for the plurality of touring collection vehicles based on the gathered results; and issues collection instructions for collecting the liquefied raw garbage from the raw garbage liquefying devices to the touring collection vehicles based on the visit plan.

9. The method of collecting liquefied raw garbage according to claim 1, wherein the central station gathers and loads to a homepage operational status data for the plurality of raw garbage liquefying devices by exchanging information through radio communications with the raw garbage liquefying devices, identifies a user having accessed the homepage via the Internet by means of an ID and password, and supplies the operational status data for the raw garbage liquefying devices to a user for whom the ID and password are correct.

10. A system for collecting liquefied raw garbage, which comprises:

a plurality of raw garbage liquefying devices respectively for accumulating liquefied raw garbage that are situated in a plurality of locations by means of a plurality of touring collection vehicles, and a central station for exchanging information through radio communications with the plurality of raw garbage liquefying devices, and the central station comprising:

liquefied raw garbage accumulation state monitoring means for monitoring an accumulation state of the liquefied raw garbage in each of the plurality of raw garbage liquefying devices, based on exchanging information with the plurality of raw garbage liquefying devices; and collection instruction issuing means for issuing collection instructions for collecting the liquefied raw garbage from the plurality of raw garbage liquefying devices through radio communications to the plurality of touring collection vehicles, based on the results of the monitoring performed by the liquefied raw garbage accumulation state monitoring means.

11. The system for collecting liquefied raw garbage according to claim 10, wherein the exchanging of information between the plurality of raw garbage liquefying devices and the central station is carried out by packet transmission based on instructions from the raw garbage liquefying devices or from the central station.

12. The system for collecting liquefied raw garbage according to claim 10, wherein the raw garbage liquefying devices comprise:

liquefied raw garbage accumulated amount detecting means for detecting current liquefied raw garbage accumulated amount thereof; and notifying means for notifying the liquefied raw garbage accumulation data thus detected by the liquefied raw garbage accumulated amount detecting means to the central station at prescribed intervals or upon a request from the central station.

13. The system for collecting liquefied raw garbage according to claim 10, wherein the touring collection vehicles comprise:

position detecting means for detecting current position of the touring collection vehicle;

liquefied raw garbage collected amount detecting means for detecting current liquefied raw garbage collected amount of the touring collection vehicle; and notifying means for notifying the current position of the touring collection vehicle as detected by the position detecting means and the current liquefied raw garbage collected amount as detected by the liquefied raw garbage collected amount detecting means to the central station at prescribed intervals or upon a request from the central station.

14. The system for collecting liquefied raw garbage according to claim 13, wherein the notifying means notifies the current position of the touring collection vehicle as detected by the position detecting means and the current liquefied raw garbage collected amount as detected by the liquefied raw garbage collected amount detecting means by packet transmission based on instructions from the touring collection vehicle or the central station.

15. The system for collecting liquefied raw garbage according to claim 10, wherein the central station comprises:

liquefied raw garbage accumulated amount gathering means for gathering liquefied raw garbage accumulated amount of each of the plurality of raw garbage liquefying devices by exchanging information through radio communications with the raw garbage liquefying devices;

touring collection vehicle information gathering means for gathering respective position and liquefied raw garbage collected amount of the plurality of touring collection vehicles by exchanging information through radio communications with the touring collection vehicles; and visit plan creating means for creating a visit plan for the plurality of touring collection vehicles based on the results gathered by the liquefied raw garbage accumulated amount gathering means and the touring collection vehicle information gathering means;

wherein the collection instruction issuing means issues collection instructions for collecting the liquefied raw garbage from the raw garbage liquefying devices to the touring collection vehicles based on the visit plan created by the visit plan creating means.

* * * * *